US010989121B2

(12) United States Patent
Wibberley

(10) Patent No.: US 10,989,121 B2
(45) Date of Patent: Apr. 27, 2021

(54) FUEL SYSTEM FOR DIESEL ENGINES USING CARBONACEOUS AQUEOUS SLURRY AND EMULSION FUELS

(71) Applicant: COMMONWEALTH SCIENTIFIC AND INDUSTRIAL RESEARCH ORGANISATION, Australian Capital Territory (AU)

(72) Inventor: Louis James Wibberley, New South Wales (AU)

(73) Assignee: COMMONWEALTH SCIENTIFIC AND INDUSTRIAL RESEARCH ORGANISATION, Australian Capital Territory (AU)

( * ) Notice: Subject to any disclaimer, the term of this patent is extended or adjusted under 35 U.S.C. 154(b) by 33 days.

(21) Appl. No.: 16/381,397

(22) Filed: Apr. 11, 2019

(65) Prior Publication Data

US 2019/0338712 A1 Nov. 7, 2019

(30) Foreign Application Priority Data

May 3, 2018 (AU) ..... 2018901502

(51) Int. Cl.
*F02D 19/04* (2006.01)
*F02M 43/00* (2006.01)
*F02D 19/06* (2006.01)

(52) U.S. Cl.
CPC ..... *F02D 19/04* (2013.01); *F02D 19/0657* (2013.01); *F02M 43/00* (2013.01)

(58) Field of Classification Search
CPC ..... F02D 19/04; F02D 19/0657; F02M 43/00
See application file for complete search history.

(56) References Cited

U.S. PATENT DOCUMENTS 4,825,842 A * 5/1989 Steiger ..... F02D 19/04 123/23

FOREIGN PATENT DOCUMENTS

| | | | |
|---|---|---|---|
| WO | 2013/142921 | A1 | 10/2013 |
| WO | 2015/048843 | A1 | 4/2015 |
| WO | 2017/120637 | A1 | 7/2017 |

OTHER PUBLICATIONS

Kyle Nicol: The direct injection carbon engine: IEA Clean Coal Centre report CCC/243, Dec. 2014—https://www.nsea.org/sites.delirult/files/122014_The%20direct%20injection%20carbon%20engine_ccc243.

(Continued)

*Primary Examiner* — Kevin A Lathers
(74) *Attorney, Agent, or Firm* — Ladas & Parry LLP

(57) ABSTRACT

A fuel circulation system of a diesel type engine configured to use carbonaceous aqueous slurry or emulsion fuels. The diesel type engine includes a fuel injection system which is fluidly connected to the fuel circulation system. The fuel circulation system comprises: at least one fuel feed pump comprising a positive displacement pump located in the fuel circulation system before the fuel injection system, the fuel feed pump configured to supply a controlled amount of carbonaceous aqueous slurry fuel to the fuel injection system; and at least one volumetric flow controller comprising at least one of a second positive displacement pump configured to operate in reverse as a positive displacement pressure let-down device, or a volumetric flow valve operated as a positive displacement pressure let-down device, the volumetric flow controller located in the fuel circulation system after the fuel injection system, the volumetric flow controller providing a controlled regulation of return flow/fuel system pressure from the fuel injection system from zero to maximum flow/pressure.

9 Claims, 2 Drawing Sheets

(56) References Cited

OTHER PUBLICATIONS

Louis J. Wibberley: (2013) Coal base-load power using micronised refined coal (MRC): Energy Generation, pp. 35-39 (Jan.-Mar. 2011).

* cited by examiner

FUEL SYSTEM FOR DIESEL ENGINES USING CARBONACEOUS AQUEOUS SLURRY AND EMULSION FUELS

CROSS REFERENCE

The present application claims priority from Australian Provisional Patent Application No. 2018901502 filed on 3 May 2018 the contents of which should be understood to be incorporated into this specification by this reference.

TECHNICAL FIELD

The present invention generally relates to a fuel system for a diesel type engine using carbonaceous aqueous slurries and/or emulsion fuels. The invention provides a method and system for controlling fuel circulation in a diesel type engine using carbonaceous aqueous slurries and it will be convenient to hereinafter disclose the invention in relation to that exemplary application.

BACKGROUND OF THE INVENTION

The following discussion of the background to the invention is intended to facilitate an understanding of the invention. However, it should be appreciated that the discussion is not an acknowledgement or admission that any of the material referred to was published, known or part of the common general knowledge as at the priority date of the application.

Current injection technology for conventional diesel and heavy fuel oil in diesel engines employs pressure atomisation of relatively low viscosity fuel. For heavy fuel oils the fuel viscosity is controlled to 5 to 20 mPa·s by heating (up to 165° C.) before the fuel enters the engine high pressure injection system. Low pressure fuel is provided at relatively constant pressure of 10 to 20 bar to the fuel system to provide a steady circulation and bleed of fuel oil to occur back to the hot service tank via a pressure relief valve/controlled pressure valve and spring loaded clack valves in the injectors. Clack valves in the engine automatically snap open after each injection enabling circulation of fuel through the injector, and snap shut once the injection event starts. This circulation facilitates maintaining the fuel system at elevated temperature, removal of air, and facilitates fuel switching, for example from heavy fuel oil to a lighter low sulphur grade when entering coastal waters.

An emerging technology is to use carbonaceous aqueous slurry fuels such as coal water slurries or bitumen water slurries to replace heavy fuel oil for diesel engines. It is noted that bitumen water slurries, such as MSAR (Multi-Phase Superfine Atomized Residue—an oil in water emulsion fuel), are essentially a slurry of solid bitumen particles in water at temperature below around 60° C., whereas at higher temperatures the bitumen is in the form of viscous droplets in water (i.e. an emulsion). The properties of these slurry and emulsion fuels are significantly different to diesel and fuel oils. For example, slurry and emulsion fuels have a tendency to destabilise and settle to form sludge or tarry deposits in the fuel system. These fuels are also much more abrasive and prone to cavitation than fuel oils, both of which cause accelerated wear of fuel system components such as the valve seats in pressure relief and clack valves. The intense turbulence and shear caused by these valves is also likely to accelerate destabilisation of the fuel resulting in agglomeration of the carbonaceous particles or droplets which increases the formation of deposits in the fuel system.

Agglomeration and deposits affect atomisation and combustion efficiency and can lead to fuel system blockages. Fuel pressure can be controlled to the engine using a variable speed pump to avoid the use of pressure relief valves. However, during engine stops or load operation, the fuel is essentially deadheaded and maintained under high pressure without appreciable flow. In this mode of operation, destabilisation and other changes in fuel rheology can occur forming deposits along the fuel system which can subsequently dislodge when fuel flow resumes to collect and form a plug in the fuel system—especially where sudden changes in flow area or flow direction occur.

The production, transportation, storage and use of carbonaceous slurry and emulsion fuels therefore cause a number of technical problems which have discouraged commercialisation of this type of fuel.

Current art to avoid these settling and destabilisation problems have been similar to those for heavy fuel oil—namely to:

1). constantly circulate preheated fuel around the fuel system under a relatively constant fuel delivery pressure controlled by using a pressure relief valve on the circulation main after the injection pumps or HEUI-type booster injectors;

2). allow fuel to bleed fuel from the high pressure circuit of the fuel injector via an automatic spring-loaded bleeder/clack valve; and 3). use variable speed low pressure fuel pumps or fuel supply pumps.

A simplified schematic of a heavy fuel oil system is shown in FIG. 1.

The inventors have discovered that these current solutions are unlikely to be ideal for commercial operation of engines with carbonaceous slurries or carbonaceous emulsion fuels. The inventors have discovered that slurries and bitumen emulsions (effectively slurries at ambient temperature) behave adversely to 1) high shear or cavitation conditions such as experienced through pressure relief valves and throttling valves, and 2) to deadheading. In addition it has been discovered that these effects increase significantly with increased fuel temperature and by contamination of the circulating slurry from the use of seal oil to protect fuel pump plungers and valve spindles.

An additional problem with current diesel type engine configurations is the inability to perform complete and rapid flushing of the fuel system after the service tank without extended operation of the engine with the flushing fluid. What is not obvious is that flushing fluid for carbonaceous aqueous slurries is mostly likely an essentially incombustible fluid such as water or a suitable detergent mixture, as use of diesel or fuel oil for flushing can cause rapid agglomeration of carbonaceous particles in slurries or emulsions and fuel system blockages. In addition, even with a dual fuel injection system with a separate fuel system to operate the engine during flushing, excessive use of flushing fluid with low by-pass circulation systems are likely to be undesirable due poor combustion of diluted slurry fuel and the amount of flushing fluid entering the combustion chambers of the engine.

It would therefore be desirable to achieve at least one of the following:

- reduce the degradation, destabilisation and agglomeration of carbonaceous aqueous slurry or emulsion fuels in engine fuel systems by maintaining a controlled flow of fuel around the fuel system without the use of pressure relief valves, automatic clack valves or deadheaded fuel pumps;

provide more efficient and controlled method of flushing of the fuel system to minimise the injection of flushing fluid into the engine;

minimise abrasive and cavitation wear of fuel system components; or provide increased temperature control of the fuel provided to the engine to substantially eliminate the need for fully preheating the fuel to the service tank, and in some cases may avoid the need for a service tank for the slurry/emulsion fuel.

SUMMARY OF THE INVENTION

The present invention provides an improved method for controlling fuel circulation in diesel engines in diesel type engines using carbonaceous aqueous slurry fuels and carbonaceous emulsions fuels that include carbonaceous particles suspended in an aqueous medium such as those formed from coal, chars, carbon blacks and bitumens. Embodiments of the present invention can be configured to use a carbonaceous aqueous slurry fuel characterised as a type of micronized refined carbon fuel (MRC).

A first aspect of the present invention provides a fuel circulation system of a diesel type engine configured to use carbonaceous aqueous slurry or emulsion fuels. The diesel type engine includes a fuel injection system which is fluidly connected to the fuel circulation system. The fuel circulation system comprises:

at least one fuel feel pump comprising a positive displacement pump located in the fuel circulation system before the fuel injection system, the fuel feed pump configured to supply a controlled amount of carbonaceous aqueous slurry fuel to the fuel injection system; and at least one volumetric flow controller comprising at least one of a second positive displacement pump configured to operate in reverse as a positive displacement pressure let-down device, or a volumetric flow valve operated as a positive displacement pressure let-down device, the volumetric flow controller located in the fuel circulation system after the fuel injection system, the volumetric flow controller providing a controlled regulation of return flow/fuel system pressure from the fuel injection system from zero to maximum flow/pressure.

The present invention provides a new fuel circulation/delivery system in which the fuel feed pump in combination with an additional pump or volumetric flow valve is used as a combination pressure let down and flow/pressure control device, to control flow through the fuel injection system. By operating a suitable positive displacement pump in reverse (for example a progressive cavity pump) or a volumetric flow valve, pressure let down can be achieved without throttling through a valve, as is normal for fuel oils. This provides a number of advantages for slurry fuel by avoiding the rapid erosion-corrosion/cavitation wear of normal throttling devices, and by substantially reducing changing the fuel particle size and/or rheology caused by throttling.

The new fuel circulation system can be utilised with appropriate control strategy to substantially eliminate destabilisation of the fuel and sedimentation in fuel lines, abrasive and cavitation wear of fuel system components, whilst providing increased temperature, pressure and flow control needed for the slurry or emulsion fuels. The control strategy and associated method is discussed below.

In the system of the present invention, the fuel feed pump is operated normally to pump fuel flow to the fuel injection system. The volumetric flow controller, comprising either a positive displacement pump (volumetric flow controller) configured to be operated in reverse, or a volumetric flow controller are configured to control volumetric flow through the valve as a proportion to pump or valve operating speed. The fuel circulation system of the present invention can therefore operate without the use of pressure relief or flow regulation valves. By avoiding high shear relief or let down valves and providing increased flexibility in flow and pressure control, destabilisation and rheology changes to the fuel can be minimised. Abrasion and cavitation wear of fuel system components is also reduced. Improved temperature control can be provided. Improved fuel system flushing or fuel switching can be performed.

It should be appreciated that the fuel circulation system of the present invention is suitable for use in diesel type engines such as diesel type compression ignition engines. It should also be understood that the term "diesel type engine" encompasses any engine manufactured, constructed or modified to operate using a fuel including carbonaceous particles suspended in an aqueous medium. Suitable engines include conventional compression ignition or diesel type engines, dual fuel engines using direct injection of the carbonaceous fuel, or an engine improved, modified or otherwise derived from conventional compression ignition or diesel type engines to operate using a fuel including carbonaceous particles suspended in an aqueous medium. One example is a direct injection carbon engine (DICE)—a diesel type engine which has been modified to enable combustion of water-based slurry of micronised refined carbon fuel (MRC).

The present invention is suitable for use in a variety of fuel injection systems. By way of example, the present invention is suitable for use in a conventional injection arrangement whereby a fuel pumping element comprising a plunger is housed within a pump chamber. In these systems, the pump chamber is in communication with an injector nozzle via a fuel duct or fuel conduit connecting the nozzle to the pump chamber. The injector nozzle typically includes an injector valve biased to a normally closed position to regulate the injection of fuel into the combustion chamber. In this arrangement, downward movement of the plunger reduces the volume of the pump chamber causing an increase in pressure within the volume of fuel occupying the pump chamber and the fuel duct. This pressurises fuel for supply to the injector nozzle. This pressure increase overcomes the bias in the normally closed injector valve which moves to an open position in which fuel is permitted to spray from the injector nozzle into the combustion chamber. The release of fuel into the combustion chamber reduces pressure upstream of the injector nozzle causing the injector nozzle valve to return to its normally closed position whereupon spray through the injector nozzle is terminated. The pressurised fuel flow generated by the plunger travels away from the plunger and toward the injector nozzle via an injection path which is therefore defined by the collective volumes of the pump chamber and the fuel duct.

As noted above, the present invention is suitable for use with existing fuel injection arrangements which utilise a plunger-type fuel pumping element and a pressure-actuated injector nozzle. However it will be appreciated that these are merely some examples of a fuel pumping element and injector nozzle with which the present invention can be used. A variety of alternative fuel pumping systems and injector nozzles are suitable for use with the present invention. For example, the pump chamber and pumping element of the present invention may comprise any type of appropriate flow generating device depending on a desired injection pressure for example a moving cavity pump, or a positive displacement pump such as a diaphragm pump. In embodiments of the invention where the fuel pumping element comprises a piston or plunger-type pumping element, the piston/plunger can be operated by a variety of actuation systems for example a cam arrangement, hydraulic arrangement or by an electronic solenoid system. Similarly, the injector nozzle of the present invention can be a conventional type injector nozzle (i.e. actuated to its open position by increasing pressure within the injection path) or, alternatively, could be selectively actuated by a separate system (for example a hydraulic or electronic system) to provide increased control over the injection events into the combustion chamber which, in some engine systems, are precisely timed to achieve increased combustion efficiency.

The carbonaceous aqueous slurry fuel used in the diesel type engine of the present invention comprises carbonaceous particles suspended in an aqueous medium. This fuel typically comprises an aqueous colloidal suspension of finely ground carbonaceous particles. The suspension can have a paste consistency. Furthermore, the carbonaceous particles are preferably hydrophobic as it improves the dispersion of the particles within the medium. One suitable example is taught in International Patent Publication No. WO2015048843A1, the contents of which should be understood to be incorporated into this specification by this reference.

Carbonaceous emulsion or emulsified fuels used in the diesel type engine of the present invention are emulsions composed of water and a combustible carbonaceous liquid, either oil or a fuel, for example bitumen. One particular example of a carbonaceous emulsion fuel is a bitumen emulsion fuels. Another example is MBAR (Multi-Phase Superfine Atomized Residue), by Quadrise Ltd. and now further developed by Quadrise Canada Fuel Systems, Inc. MSAR™ comprises an oil-in-water emulsion fuel where the oil is a hydrocarbon with an API gravity between 15 and −10. Typical oil-water ratios lie in the range 65% to 74%.

It should be appreciated that a volumetric flow valve is a valve configured to control volumetric flow through the valve as a proportion to valve operating speed. Examples include star-valves, lobe valves or other rotary flow valves. In preferred embodiments, the volumetric flow controller comprises a star-valve or rotary flow valve. However, it should be appreciated that other types of volumetric flow valves could be used.

The fuel feed pump is used to deliver fuel to the injection system, and ultimately the fuel injectors of the diesel type engine. In this sense, the fuel feed pump is typically in fluid communication with an inlet of each injector of the fuel injection system. The fuel feed pump and embodiments of the volumetric flow controller comprise positive displacement pumps. It should be appreciated that the term positive displacement is used to describe pumps wherein the fluid flow through the pump is substantially proportional to pump speed, and includes spindle pumps and progressive cavity type pumps.

Accordingly, in embodiments of the present invention each of the first and second positive displacement pumps comprises a reciprocating pump or a rotary pump. Examples of suitable positive displacement pump comprise at least one of a plunger pump, diaphragm pump, rotary lobe pump, progressing cavity pump, rotary gear pump, piston pump, diaphragm pump, screw pump, gear pump, vane pump, regenerative (peripheral) pump, peristaltic pump or spindle pump.

In a preferred embodiment, the at least one volumetric flow controller comprises a second positive displacement pump configured to operate in reverse. In this embodiment, the present invention provides a fuel circulation system of a diesel type engine configured to use carbonaceous aqueous slurry or emulsion fuels, the diesel type engine including a fuel injection system which is fluidly connected to the fuel circulation system, the fuel circulation system comprising:

at least one fuel feed pump comprising a positive displacement pump located in the fuel circulation system before the fuel injection system, the fuel feed pump configured to supply a controlled amount of carbonaceous aqueous slurry fuel to the fuel injection system; and at least one let down pump comprising a second positive displacement pump configured to operate in reverse as a positive displacement pressure let-down device, the let down pump located in the fuel circulation system after the fuel injection system, the let down pump providing a controlled regulation of return flow/fuel system pressure from the fuel injection system from zero to maximum flow/pressure.

While it is advantageous that the feed pump and volumetric flow controller are variable speed to provide maximum flexibility in regards to flowrate, it should be appreciated that in embodiments one of the feed pump or volumetric flow controller can be operated at constant speed, with pressure regulation of the fuel flowing through the fuel injection system being controlled by adjusting the operation speed of the other of the feed pump or volumetric flow controller.

The circulation system of the present invention can include any number of fuel feed pumps and/or volumetric flow controllers operated in parallel. In practice several fuel feed pumps and/or volumetric flow controllers could be used in parallel to provide additional flow flexibility and supply security. In some embodiments, at least two fuel feed pumps can be used connected into the fuel circulation system and operated in parallel. In some embodiments, at least two volumetric flow controllers can be used connected into the fuel circulation system and operated in parallel.

The fuel circulation system may include a service tank into which fresh carbonaceous aqueous slurry fuel is fed. The service tank is typically fluidly connected to an inlet of the fuel feed pump. The service tank enables a reservoir of fuel to be formed for feeding into the fuel circulation system via the fuel feed pump.

In some embodiments, the fuel injection system further includes a fuel preconditioning system fluidly connected to the inlet of the injection system, the fuel preconditioning system including a first fuel preheater for heating the fuel to a service temperature prior to flowing to the service tank. The preconditioning system may also include a fuel strainer, and wherein the first fuel preheater is located before the fuel strainer. The fuel strainer typically includes a screen to remove extraneous coarse material such as flakes of rust from bunker tanks. The first fuel preheater preferably is located before the fuel strainer to reduce the fuel viscosity before screening through the strainer.

The service tank can be advantageously operated at a lower temperature than the temperature of the fuel in the injection system, which further reduces slurry destabilisation. It is likely that a service tank temperature of 20 to 70° C., preferably 25 to 40° C. will be suitable for most fuels, which less than half that currently used for emulsion fuels. For example, during normal operation of the engine, the pressure in the fuel injection system and/or the recycle stream is typically between 10 to 50 bar, more preferably between 20 to 30 bar. The temperature of the fuel in the recycle stream (after exiting the injection system) is typically between 50 to 150° C., preferably between 70 and 130° C.

The fuel circulation system can also include a second fuel preheater located between the fuel feed pump and the fuel injection system. This arrangement maximises the amount of preheat which can be used whilst minimising the storage time at elevated temperature. In such embodiments, a first fuel preheater is located in the fuel preconditioning section before the service tank, preferably before the fuel strainer for the strainer to take advantage of the reduced viscosity of the preheated slurry. Fuel preheat from each of the first preheater and the second preheater should be varied according to the properties of the slurry fuel and the expected storage time in the service tank. Fuel preheat is preferably varied according to the properties of the fuel and the return bleed flow to maximise the temperature of the injected fuel whilst minimising the average time that fuel is at elevated temperature. The second preheater typically heats the fuel flowing therethrough to a temperature of between 50 to 150° C., preferably between 70 to 130° C. The acceptable time-temperature profile will be different for different fuels.

The volumetric flow controller is typically connected to and/or within a fuel recycle stream fluidly connected to the inlet of the fuel feed pump. Here, the return flow or circulation flow is advantageously directed into the inlet of the fuel feed pump instead of the service tank to maximise the temperature of the injected fuel whilst minimising the average time that fuel is at elevated temperature thereby minimising the likelihood of destabilisation and adverse rheological changes. This also eliminates mixing hot fuel with the cooler fuel in the service tank which further reduces the tendency for destabilisation. The acceptable time-temperature profile will be different for different slurry or emulsion fuels. In some embodiments, the fuel recycle stream includes a connection to a waste stream into which flow can be selectively diverted to remove fluid from the fuel recycle stream.

In some applications the wide control range possible with the present inventive features may advantageously eliminate the need to use a service tank for the slurry or emulsion fuel, thereby reducing fuel system complexity from requiring a separate service tank for slurry/emulsion fuel and regular fuel oils, and eliminating potential destabilisation in the service tank through prolonged storage at elevated temperature.

Some embodiments of the fuel circulation system can further include a fuel circulation main, wherein the return from the fuel circulation main is fluidly connected to the inlet of the fuel feed pump. In embodiments, the fuel circulation main is provided fluidly connected between the fuel feed pump and the volumetric flow controller. The fuel recycle stream, in this embodiment including a fuel circulation main, is connected to the inlet of the fuel feed pump and not the service tank. This eliminates mixing hot fuel with the cooler fuel in the service tank and reduces the tendency for destabilisation.

The fuel recycle stream can comprise a circuit with a number of alternative connections. As noted above, the fuel recycle stream is preferably connected to the fuel feed pump in order to directly recycle the bleed fuel to the injectors. However, it can also be preferable to divert or selectively remove fluid from the recycle, for example contaminated fuel, degraded fuel, flushing fluid or the like so that that fluid is not recycled back into the fuel injectors. Therefore, in some embodiments the fuel recycle stream includes a connection to a waste stream into which flow can be selectively diverted to remove fluid from the recycle stream. Any suitable fluid connection could be used. In some embodiments, the waste stream is fluidly connected to the recycle stream using a controlled three way valve. The fuel system is provided with valve to direct bleed flow to a waste tank or flushing fluid recovery system during system flushing or periods of abnormal operation.

A second aspect of the present invention provides a diesel type engine configured to use carbonaceous aqueous slurry fuels or carbonaceous emulsion fuels comprising a fuel recirculation system according to the first aspect of the present invention.

It should be understood that all the features previously discussed in relation to the first aspect of the present invention can equally be incorporated into this second aspect of the present invention.

It should also be appreciated that the diesel type engine of this second aspect of the present invention can comprise any engine capable of running using a carbonaceous aqueous slurry fuel, such as a direct-injection, compression ignition or diesel type engine. In preferred forms, the engine comprises a modified diesel type engine, such as a diesel type engine having a blast injector/blast atomiser type injector.

A third aspect of the present invention provides a method for controlling fuel circulation in a diesel type engine using carbonaceous aqueous slurry fuels, carbonaceous emulsion fuels or mixtures thereof, the diesel type engine including a fuel circulation system according to any one of the preceding claims, the method including the step of:

adjusting the relative speed of the fuel feed pump and the volumetric flow controller is adjusted to control at least one of:

(i) fuel supply pressure; or (ii) fuel flow rate in the fuel circulation system.

The overall control strategy for the present invention is control the fuel supply pressure, i.e. pressure in the fuel circulation system before the fuel injection system (typically pressure in a fuel rail supplying the fuel injection system and comprising fuel injector pumps) by controlling the speed of the feed pump, and to control the fuel flow rate in the fuel circulation system, and in particular the rate of return flow using the speed of the volumetric flow controller. This is achieved by controlling the relative speed of the fuel feed pump and the volumetric flow controller.

It should be appreciated that there there are two fuel pressures in the engine: 1) fuel supply pressure, the pressure in the fuel supply to the fuel injector system (which includes fuel injector pumps); and 2) high pressure fuel from the injection pumps in the fuel injector system. It is to be understood that the present invention controls pressure (1) (together with the let down flow/return flow from the fuel injector system in the fuel circulation system).

It should be understood that all the features previously discussed in relation to the first aspect of the present invention can equally be incorporated into this third aspect of the present invention.

In embodiments where the fuel circulation system includes a preheater fluidly connected between the fuel feed pump and fuel injection system, the relative speed of the fuel feed pump and the volumetric flow controller can be adjusted to achieve a desired fuel temperature by increasing the heat transfer coefficient on the fuel side of the preheater.

Moreover, in some embodiments the relative speed of the fuel feed pump and the volumetric flow controller is adjusted to control at least one of:

fuel flow rate (i.e. sufficient fuel flow rate) to prevent particle sedimentation in the fuel;

changes to the fuel rheology and destabilisation by over working due to excessive circulation around the fuel system and preferably minimise these changes;

fluid flow for fuel change over; or flow of flushing fluid for more efficient and quicker flushing of the fuel system.

It should be appreciated that controlled bleed valves can be used in the fuel injection system on each injector thereof provides a regulated circulating flow carbonaceous aqueous slurry fuel through the fuel injection system. One suitable controlled bleed valves system is taught in Applicant's international patent publication No. WO2017/120637A1, the contents of which should be considered to be incorporated into this specification by this reference.

The controlled bleed valve is preferably operated to allow flow from the fuel injector after the fuel injection pump draws fuel into the injector and before the fuel injector injects fuel through the injector nozzle. In embodiments, the fuel injector pump comprises a plunger pump including a cylinder and driven plunger for pumping fuel to the injector nozzle and the fuel injection pump draws fuel into the injector through retraction of the plunger.

The bleed flow is preferably controlled by the duty of the bleed valve for a given fuel delivery pressure. In embodiments, each controlled bleed valve is fluidly connected to a fuel recycle system. Here, pressure drop in the recycle stream is preferably controlled by a pressure drop in internal flow channels in the injector before and after the electronically controlled bleed valve. This pressure drop is controlled to reduce the shear intensity experienced by the bleed flow passing over throttling valves.

During normal engine operation, the fuel recycle stream preferably directs fuel from the bleed valves to the inlet of the fuel feed pump. This bleed and recycle flow directly recycles the bleed flow to the fuel injection system thereby avoiding contaminating the service or day tank(s) with hot degraded/contaminated fuel, and reducing the time before hot degraded fuel is injected into the engine.

In those embodiments where the fuel injection system further includes a injector bleed or by-pass valve for regulating circulating flow carbonaceous aqueous slurry fuel through the fuel injection system, the relative speed of the fuel feed pump, the volumetric flow controllers and the injector bleed or by-pass valves can be adjusted to control at least one of:

(i) fuel supply pressure (i.e. fuel injection system and comprising fuel injector pumps (for example high pressure injection pumps));

(ii) fuel flow rate to prevent particle sedimentation in the fuel; or (iii) fuel flow rate to minimise adverse changes to the fuel rheology and destabilisation by over working due to excessive circulation around the fuel system.

Similarly, in embodiments where the fuel injection system further includes a injector bleed or by-pass valve for regulating circulating flow carbonaceous aqueous slurry fuel through the fuel injection system, the relative speed of the fuel feed pump, the volumetric flow controller and the injector bleed or by-pass valves can be adjusted to control at least one of:

(i) fuel supply pressure;

(ii) fuel flow rate.

(iii) fuel flow rate to prevent particle sedimentation in the fuel; or (iv) fuel flow rate to minimise adverse changes to the fuel rheology and destabilisation by over working due to excessive circulation around the fuel system.

(v) fluid flow for fuel change over.

(vi) flow of flushing fluid to achieve more efficient and quicker flushing of the fuel system.

It should be appreciated that the required fuel supply pressure (again typically embodied in a fuel rail pressure) of the fuel injection system will vary according to engine load, engine speed, and the flow properties of the fuel. For example, at full load the fuel pressure required to refill the injection pump after each injection event might be 25 bar, whereas at low load 5 bar could suffice. These are typical values required for full scale injection system for a low speed engine using a slurry containing 58 weight percent coal. In the same system, which injected 900 kg/h, reliable fuel flow without setting or clogging can be achieved using a return flow of 75 kg/h. This flow rate would normally be the minimum to ensure freedom from clogging, and would be maintained even when the engine was stopped. In this case the fuel feed pump would continue to maintain a minimum fuel pressure in the system—say 2 bar.

The fuel circulation system of the present invention can be used in a number of applications. In some embodiments, the fuel circulation system is used in a stationary power generation engine. In these embodiments, the engine comprises a large engine typically fixed in place within a building or other enclosure which primarily used to generate electricity. In other embodiments, the fuel circulation system is used in a transportation engine, typically to propel a vessel. Examples of transportation engines include use of an engine to power and propel locomotives, ocean going vessels such as ships, ocean liners, barges or the like. However, it should be appreciated that other vehicle engines such as trucks or the like could utilise suitable sized and powered engines using the fuel circulation system of the present invention.

BRIEF DESCRIPTION OF THE DRAWINGS

The present invention will now be described with reference to the figures of the accompanying drawings, which illustrate particular preferred embodiments of the present invention, wherein.

DETAILED DESCRIPTION

The present invention relates to a fuel circulation system and related method for controlling fuel circulation in diesel type engines using carbonaceous aqueous slurry fuels. A schematic of the preferred arrangement embodying the inventive features is shown in FIG. 2.

Figure 1:
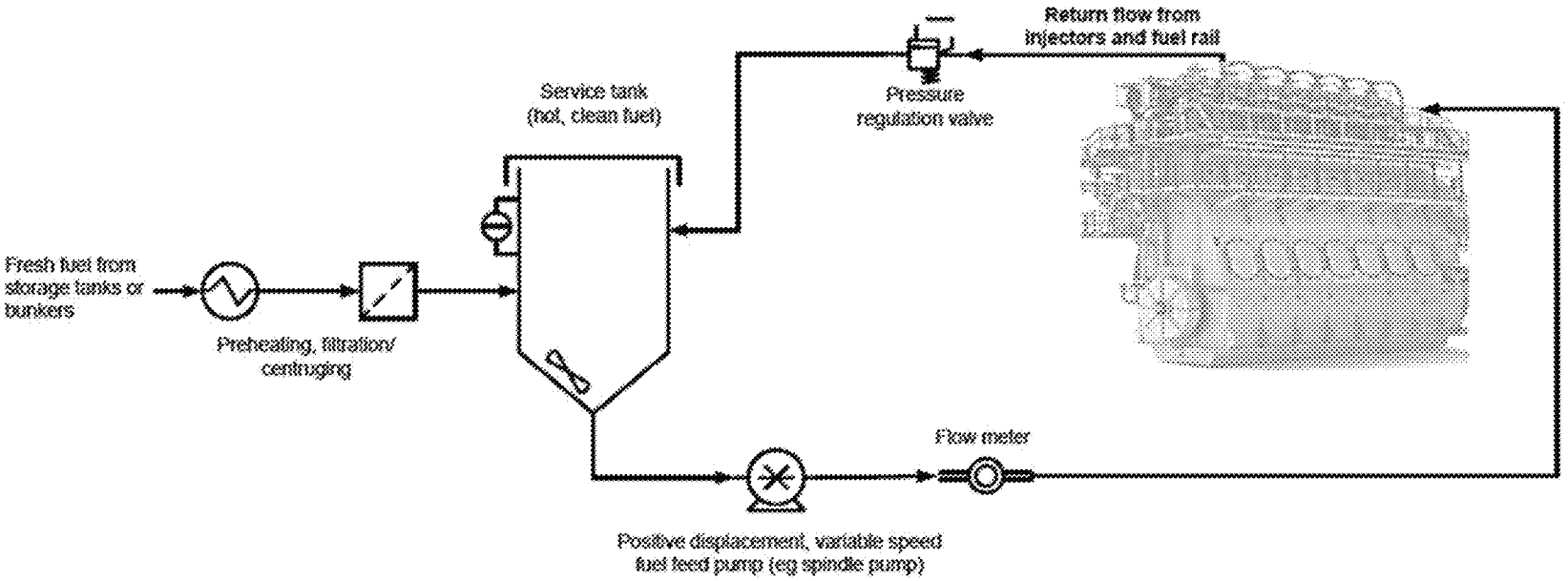
Figure 1 (Prior Art)
FIG. 1 provides a schematic of a prior art arrangement of a simplified heavy fuel oil system showing return flow to service tank from a pressure regulation valve.
Figure 2:
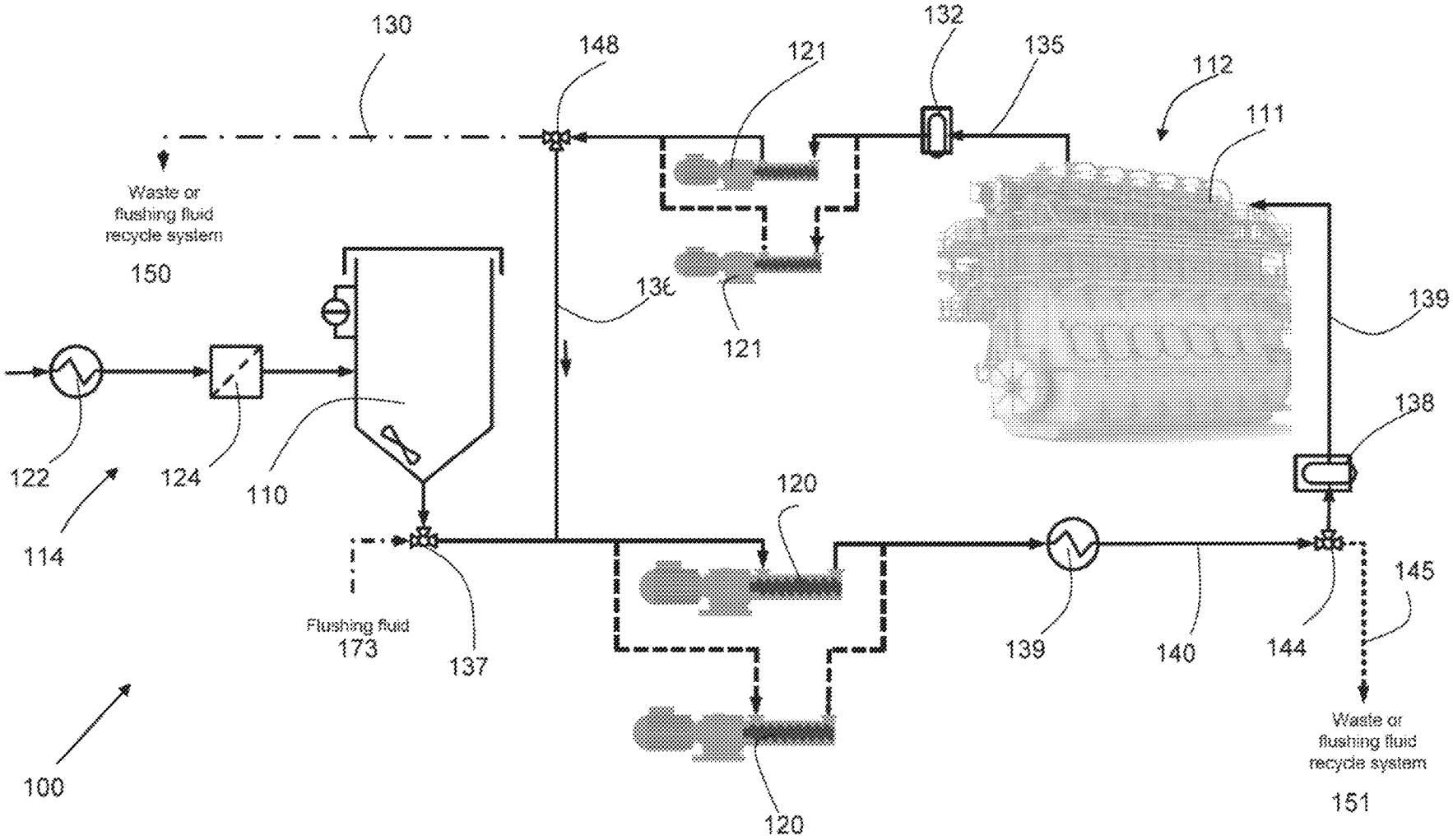
FIG. 2 provides a schematic of an engine fuel system including a fuel circulation system according to one embodiment of the present invention having 5% return flow to feed pump inlet.

The fuel circulation system 100 (FIG. 2) of the present invention uses a positive displacement pump 120 and a volumetric flow controller 121, shown as a second positive displacement pump (let down pump 121) in FIG. 2 to control flow through the fuel injection system. The fuel feed pump 120 is operated normally to pump fuel flow to the fuel injection system. The second positive displacement pump (volumetric flow controller 121) configured to be operated in reverse is configured to control volumetric flow through the valve as a proportion to pump or valve operating speed. Each of the fuel feed pump 120 and a volumetric flow controller 121 can be operated together to control fuel flow rate, fuel pressure, sedimentation properties, destabilisation and rheology changes to the fuel and various other parameters in the operation of the diesel type engine. Abrasion and cavitation wear of fuel system components can also be reduced. Improved temperature control can be provided. Improved fuel system flushing or fuel switching can be performed. Moreover, the fuel circulation system of the present invention can therefore operate without the use of pressure relief or flow regulation valves.

It should be appreciated carbonaceous aqueous slurry fuels comprise an aqueous slurry or suspension type fuel that includes carbonaceous particles suspended in an aqueous medium. The carbonaceous particles may be sourced from any suitable carbonaceous source including, but not limited to a variety of coal, chars, bitumen, charcoal, wood, various hydrocarbons, and organic matter whether biological in nature or organic compounds etc. Preferably, the carbonaceous material is coal. Any type of coal may be used, for example anthracite, bituminous coal, or a brown or lignitic coal may be used. This is particularly advantageous as coal is readily available as a carbonaceous source. It is preferred that the carbonaceous source has low ash content, preferably less than 2 wt %, more preferably less than 1 wt %, most preferably less than 0.5 wt %. An example of one suitable type of carbonaceous aqueous slurry fuels is taught in International Patent Publication No. WO2015048843A1 by the same applicant, the contents of which again should be understood to be incorporated into this specification by this reference.

In the case where the carbonaceous particles are coal, it is preferred that the coal has undergone some form of pre-treatment. Pre-treatment may include removal of the bulk of the mineral ash contamination and in the case of the lower rank coals some form of densification and alteration of the surface properties to render the coal more hydrophobic to enable a fuel with a higher coal loading to be achieved. For example bituminous coal demineralisation can be achieved by selective agglomeration, flotation and cyclones. An example of one suitable injector nozzle, forming part of a blast atomiser type injector is taught in International Patent Publications WO2013142921A1 and WO2015048843A1 by the same applicant, the contents of which again should be understood to be incorporated into this specification by this reference.

Carbonaceous aqueous slurry fuels can be used to replace heavy fuel oil for diesel type engines, particularly for stationary electricity generation at greater than the 5 MW scale, and for large shipping. The fluid properties of coal water slurry fuels are significantly different to diesel and fuel oils, in particular the coal slurry have a much higher shear-thinning non-Newtonian viscosity, and both the coal particles and contaminant mineral particles are abrasive to low hardness steel, preventing the fuel from lubricating the fuel system. Coal water slurry fuels have been successfully demonstrated in adapted diesel type engines in a number of demonstration programs—provided hardened fuel system components were used, and the fuel had a sufficiently low viscosity.

Embodiments of the present invention can be configured to use a carbonaceous aqueous slurry fuel characterised as a type of micronized refined carbon fuel (MRC). Micronising involves fine milling a solid carbonaceous (carbon-containing) material to about 10 to 60 microns. Refining involves physically cleaning the carbonaceous material, so as to remove most of the mineral matter to produce a fuel with approximately 1 percent mineral content. The fine carbonaceous material and water are combined to produce an aqueous slurry/suspension containing 40 to 50% water.

Embodiments of the present invention can also be configured to use a carbonaceous emulsion fuel, for example a bitumen water slurry, such as MSAR (Multi-Phase Superfine Atomized Residue), are essentially a slurry of solid bitumen particles in water at temperature below around 60° C., whereas at higher temperatures the bitumen is in the form of viscous droplets in water (i.e. an emulsion). Multi-Phase Superfine Atomized Residue), by Quadrise Ltd, and now further developed by Quadrise Canada Fuel Systems, Inc. MSAR™ is an oil-in-water emulsion fuel where the oil is a hydrocarbon with an API gravity between 15 and −10. Typical oil-water ratios lie in the range 65% to 74%. Typical mean oil droplet size characteristics of MSAR are around 5 microns, whereas typical mean droplet size characteristics produced during fuel oil atomization in a burner atomizer are between 150 and 200 microns. Other suitable emulsion fuels are taught for example in United States patent publication No. US20080148626A1 the contents of which should be understood to be incorporated into this specification by this reference.

It should be appreciated that the present invention is suitable for use in a directly injected combustion chamber of a compression ignition or diesel type engine. The particular engine may therefore comprise a conventional compression ignition or diesel type engine, or an engine improved, modified or otherwise derived from conventional compression ignition or diesel engines to operate using a fuel including carbonaceous particles suspended in an aqueous medium.

One example is a direct injection carbon engine (DICE)—which is one type of a diesel type engine 112, which has been modified to enable combustion of water-based slurry of micronised refined carbon fuel (MRC) as shown in FIG. 2.

FIG. 2 provides a schematic of the one embodiment of the fuel circulation system 100 according to the present invention that provides about 5% return flow to the fuel feed pump 120 fluidly connected to an inlet of the fuel injection system 111 of diesel type engine 112. However, it should be appreciated (as described below) that in flushing, mode that return flow may be up to 100%. Similarly, the bleed flow from the fuel injection system 111 may also be adjusted to maintain system temperature.

The illustrated fuel circulation system supplies fresh fuel from a service tank 110 to diesel type engine 112. The service tank 110 is typically a closed tank located proximate the engine 112 containing a reservoir of fuel for that engine 112. The service tank 112 is advantageously operated at a much lower temperature than that used for injection in the engine 112 which further reduces slurry destabilisation. The inventors consider that a service tank temperature of 25 to 70° C., preferably 25 to 40° C. will likely be suitable for most carbonaceous aqueous slurry fuels used in the engine 112. Valve 137 is provided to interrupt the flow from the service tank 110 and to enable pumping of a flushing fluid F into the engine fuel system. This valve could advantageously be a three-way valve or two separate valves.

The service tank 110 is connected to the diesel type engine 112 through preconditioning circuit 114 which includes a fuel feed pump (not illustrated), a first fuel preheater 122 and fuel strainer 124. Pressure and temperature of the fuel in that preconditioning circuit 114 is monitored using appropriate pressure and temperature sensors (not illustrated).

The fuel preconditioning circuit 114 is used to condition the fuel fed into service tank 110 to suitable properties (temperature, pressure, viscosity and the like) prior to being fed into the fuel injection system of the engine 112. As illustrated, a first fuel preheater 122 is located before fuel strainer 127 thereby allowing the fuel strainer 127 to take advantage of the reduced viscosity of the preheated slurry. The fuel preheater 122 can comprise any suitable fuel preheating unit, including those known in the art for diesel engines which thermally heat the fuel to a selected temperature. Similarly, the fuel strainer 127 can comprise any suitable fuel filter or straining unit, including those known in the art for diesel engines. Fuel preheat should be varied according to the properties of the fuel and the return bleed flow to maximise the temperature of the injected fuel whilst minimising the average time that fuel is at elevated temperature. The first fuel preheater 122 typically heats the fuel flowing therethrough to the service temperature of the service tank 110 (as noted above). The acceptable time-temperature profile will be different for different fuels. The present invention differs considerably from current art by allowing close control of fuel delivery conditions to the engine to achieve best combustion and thermal efficiency (maximum fuel preheat) whilst substantially reducing the time-temperature at conditions that cause fuel destabilisation.

It should be appreciated that the components of the fuel preconditioning circuit 114 are well known in the art and can be selected from known components, for example as discussed in K. Nicol "The direct injection carbon engine", IEA Clean Coal Centre report CCC/243, December 2014—https://www.usea.org/sites/default/files/122014_The%20direct%20injection%20carbon%20engine_ccc243.pdf, the contents of which should be understood to be incorporated into this specification by this reference.

These ice tank 110 feeds fuel to the fuel feed pump 120.

The illustrated fuel feed pump 120 and volumetric flow controller 121 (illustrated as let down pump 121) comprise positive displacement pumps. As previously noted, positive displacement pumps are pumps where the fluid flow through the pump is substantially proportional to pump speed, and includes spindle pumps and progressive cavity type pumps. Any suitable positive displacement pump can be used including reciprocating or rotary pumps. Examples of suitable positive displacement pump comprise at least one of a plunger pump, diaphragm pump, rotary lobe pump, progressing cavity pump, rotary gear pump, piston pump, diaphragm pump, screw pump, gear pump, vane pump, regenerative (peripheral) pump, peristaltic pump or spindle pump.

However, in alternate embodiments (not illustrated) the volumetric flow controller 121 may comprise a volumetric flow valve configured to control volumetric flow through the valve as a proportion to valve operating speed. Examples include star-valves, lobe valves or other rotary flow valves. It should be appreciated that other types of volumetric flow valve could also be used.

Other embodiments of the circulation system 100 can include any number of fuel feed pumps 120 and/or volumetric flow controllers 121 operated in parallel. In practice, several fuel feed pumps 120 and/or volumetric flow controllers 121 could be used in parallel to provide additional flow flexibility and supply security.

Fuel flow in circulation circuit of the fuel circulation system 100 normally flows from the fuel feed pump 120, through the second fuel preheater 139 along feed stream 139 into the injection system 111. A bypass valve 144 can be used to divert fuel flow from fuel feed stream 140 to waste stream 145 that connects to a waste tank or flushing fluid recovery system 151 during system flushing or periods of abnormal operation to advantageously reduce the time for flushing. Valve 144 could advantageously be a three-way valve.

The second fuel preheater 139 can comprise any suitable fuel preheating unit, including those known in the art for diesel engines which thermally heat the fuel to a selected temperature. Again, fuel preheat should be varied according to the properties of the fuel and the return bleed flow to maximise the temperature of the injected fuel whilst minimising the average time that fuel is at elevated temperature. The second fuel preheater 139 typically heats the fuel flowing therethrough to a temperature of between 50 to 150° C., preferably between 70 to 130° C. Again, the acceptable time-temperature profile will be different for different fuels. The present invention differs considerably from current art by allowing close control of fuel delivery conditions to the engine to achieve best combustion and thermal efficiency (maximum fuel preheat) whilst substantially reducing the time-temperature at conditions that cause fuel destabilisation.

The fuel circulation system 100 and preheating system (using a first fuel preheater 122 and second preheater 139 provide increased temperature control of the fuel provided to the engine to substantially eliminate the need for fully preheating the fuel to the service tank 110, and in some cases may avoid the need for a service tank 110 for the slurry/emulsion fuel.

The illustrated engine 112 can comprise any engine capable of running using a carbonaceous aqueous slurry fuel, such as a direct-injection, compression ignition or diesel type engine. Examples of these engines are taught in Wibberley L J (2013) Coal base-load power using micronised refined coal (MRC). Energy Generation, pp 35-39 (January-March 2011) the contents of which should be understood to be incorporated into this specification by this reference. The illustrated engine is nominally 50 MW, having 22 t/h fuel consumption. However, it should be appreciated that fuel consumption depends on engine size, system conditions and numerous other factors.

In preferred forms, the engine 112 comprises a modified diesel type engine, such as a diesel type engine having a blast injector. It can be advantageous to use a blast atomiser injector as it directly applies the kinetic energy intensity to atomise high solids content fuel that is highly viscous with a wide size distribution, containing both a high proportion of fine material as well as a larger top size. The direct application of kinetic energy from the blast fluid circumvents frictional energy losses within the fuel allowing more atomization energy to be used efficiently (i.e. to overcome surface tension effects.) The much lower fuel velocity and larger fuel passages minimize frictional losses handling the fuel as well as admit a larger maximum size of fuel particle than would otherwise be possible. An example of one suitable blast atomiser injector is taught in International Patent Publications WO2013142921A1 and WO2015048843A1 by the same applicant, the contents of which should be understood to be incorporated into this specification by this reference.

The injection system 111 can comprise any suitable injection system for a diesel type engine. Similarly, the injection system 111 can include any suitable fuel bleed system to maintain fuel circulation through the injection system. For example, controlled bleed valves can be used in the fuel injection system 111 on each injector thereof provides a regulated circulating flow carbonaceous aqueous slurry fuel through the fuel injection system. One suitable injection system and controlled bleed valve system is taught in Applicant's international patent publication No. WO2017/120637A1, the contents of which should be considered to be incorporated into this specification by this reference.

A bleed or circulation flow then flows through circulation stream 135 from the injection system 111 in the engine 112 to volumetric flow controller 121 (shown as a let down pump/positive displacement pump in FIG. 2), and then along, fuel recirculation stream 136 to be recycled back in normal operation to the inlet of fuel feed pump 120. This recirculation flow is nominally 1 t/h in the illustrated system, though this would vary depending on system conditions. In this way, a circulation flow of fuel is maintained in the fuel circulation system. Flow meter 132 monitors the flow of fluid from the engine 112 via the circulation stream 135. Flow meter 138 monitors the flow of fluid being fed into the engine 112 via feed stream 139.

Whilst not illustrated, a circulation main could be used in the fuel injection system 111, with the return from this main being connected to the volumetric flow controller 121 as illustrated in FIG. 2. This eliminates mixing hot fuel with the cooler fuel in the service tank 110 and reduces the tendency for fuel destabilisation.

A bleed flow of fuel from the injection system 111 in the engine 112 is recycled in normal operation to the fuel feed pump 120 via fuel circulation stream 135. During flushing the fuel circulation stream 135 is connected to waste diversion stream 130 via operation of valve 148. Valve 148 can therefore be used to divert fuel flow from the fuel circulation stream 135 to a waste tank or flushing fluid recovery system 150 during system flushing or periods of abnormal operation to advantageously reduce the time for flushing. This valve 148 could advantageously be a three-way valve.

During the flushing cycle, valve 137 is operated to feed flushing fluid 173 and valve 144 and/or 148 are operated to remove waste fluid from the fuel circulation system 100 and the overall circuit. This allows the engine 112 and in particular the fuel circulation system 100 to be regularly flushed and cleaned to remove any sludge or deposits in that system. Additionally, this provides the ability to flush the fuel system and comprising fuel injection system 100 for shut-down. In this situation, the speed of let-down pump would be increased to a high rate to during fuel change over to enable rapid flushing of the fuel system supplying the injection pumps. The fuel feed pump would maintain the fuel pressure set point required for the current engine speed and load by increasing its speed and flowrate of fuel to engine fuel rail/system. During the flushing procedure contaminated fuel (containing both slurry and diesel) could advantageously be directed to a separate return tank to avoid contaminating the slurry fuel tank with fuel oil (which normally causes agglomeration of the slurry particles and settling).

The inclusion of the positive displacement fuel feed pump 120 and a volumetric flow controller 121, shown as a second positive displacement pump in FIG. 2, provided better control of the fuel circulation flow, pressure and other properties of a carbonaceous aqueous slurry fuels, carbonaceous emulsion fuels or mixtures thereof. Such control is possible by adjusting the relative speed of the fuel feed pump 120 and the volumetric flow controller 121 to control one or more of:

- fuel supply pressure;
- fuel injection system feed fuel pressure;
- fuel flow rate in the fuel circulation system;
- sufficient fuel flow rate to prevent particle sedimentation in the fuel;
- changes (minimise changes) to the fuel rheology and destabilisation by over working due to excessive circulation around the fuel system;
- fluid/fuel flow for fuel change over; or
- flow of flushing fluid for a more efficient and quicker flushing of the fuel system; or
- fuel temperature by increasing the heat transfer coefficient on the fuel side of the preheater.

The use of the circulation system 100 and control by adjusting the relative speed of the fuel feed pump 120 and the volumetric flow controller 121 also minimise abrasive and cavitation wear of fuel system components, as the fuel rheology and stability can be controlled, reducing degradation, destabilisation and agglomeration of carbonaceous aqueous slurry or emulsion fuels.

The overall control strategy for the invention is to control the pressure in the fuel rail supplying the high pressure fuel injection pumps by controlling the speed of the feed pump, and to control the rate of return flow using the speed of the let-down pump. The required fuel rail pressure will vary according to engine load, engine speed, and the flow properties of the fuel. For example, at full load the fuel pressure required to refill the injection pump after each injection event might be 25 bar, whereas at low load 5 bar could suffice. These are typical values required for full scale injection system for a low speed engine using a slurry containing 58 weight percent coal. In the same system, which injected 900 kg/h, reliable fuel flow without setting or clogging was achieved using a return flow of 75 kg/h. This flowrate would normally be the minimum to ensure freedom from clogging, and would be maintained even when the engine was stopped. In this case the fuel feed pump would continue to maintain a minimum fuel pressure in the system—say 2 bar.

Examples of typical control strategies include but should not be limited to the following. It should be noted that in these examples, the volumetric flow controller is a positive displacement pump, designated as a let down pump:

In a first example, for an engine at low load and speed and consuming 1,000 kg/h of fuel, the fuel feed pump would be controlled to give the minimum fuel pressure required to refill the injection system (and comprising injection pump/injector) between injection events (say 1,100 kg/h at 5 bar), and the let-down pump would be adjusted to give a small return flow (say 100 kg/h) out of the end of a fuel rail supplying the fuel injection system. At high engine load and speed, the fuel consumption rate might be 10,000 kg/h of fuel, the fuel feed pump would be controlled to give the minimum fuel pressure required to refill the fuel injection system between the more rapidly occurring injection events (say 10,100 kg/h at 20 bar), and the let-down pump would be adjusted to give a small return flow (say 100 kg/h) out of the end of the fuel rail supplying the fuel injection system. The flow rate of the return flow will depend on the fuel properties, with fuel prone to settling, for example, requiring a higher return flow.

In a second example, immediately prior to engine shut down it would be advantageous to flush the slurry fuel from the system and to replace this with a lighter fuel oil or diesel. In this situation, the speed of the let-down pump would be increased to a high rate to during fuel change over to enable rapid flushing of the fuel circulation system supplying the fuel injection system (and comprising fuel injection pumps/injector). During the flushing procedure contaminated fuel (containing both slurry and diesel) could advantageously be directed to a separate return tank to avoid contaminating the slurry fuel tank with fuel oil (which normally causes agglomeration of the slurry particles and settling).

As described above, it should be appreciated that controlled bleed valves can be used in the fuel injection system 111 on each injector thereof (not illustrated) to provide a regulated circulating flow carbonaceous aqueous slurry fuel through the fuel injection system. Each controlled bleed valve is operated to allow flow from the fuel injector after the fuel injection pump draws fuel into the injector and before the fuel injector injects fuel through an injector nozzle. During normal engine operation, the fuel recycle stream preferably directs fuel from the bleed valves to the inlet of the fuel feed pump. This bleed and recycle flow directly recycles the bleed flow to the fuel injection system thereby avoiding contaminating the service or day tank(s) with hot degraded/contaminated fuel, and reducing the time before hot degraded fuel is injected into the engine.

Where the fuel injection system further includes an injector bleed or by-pass valve for regulating circulating flow carbonaceous aqueous slurry fuel through the fuel injection system, the relative speed of the fuel feed pump 120, volumetric flow controller 121 and the injector bleed or by-pass valves can be adjusted to provide at least one of:

- a fuel supply pressure;
- a desired fuel flow rate;
- sufficient flow rate to prevent sedimentation;
- a flow rate to minimise adverse changes to the fuel rheology and destabilisation by over working due to excessive circulation around the fuel system;
- a flow rate to minimise adverse changes to the fuel rheology and destabilisation by over working due to excessive circulation around the fuel system; or
- a desired flow for fuel change over.

The circulation system of the present invention also provides more efficient and controlled method of flushing of the fuel system to minimise the injection of flushing fluid into the engine. The relative speed of the fuel feed pump 120 and the volumetric flow controller 121 can be adjusted to control and provide a desired flow of flushing fluid. This can provide a more efficient and quicker flushing of the fuel system.

In this situation the speed of let-down pump would be increased to a high rate to during fuel change over to enable rapid flushing of the fuel system supplying the injection pumps. The fuel feed pump would maintain the fuel supply pressure set point required for the current engine speed and load by increasing its speed and flowrate of fuel to engine fuel rail/system. During the flushing procedure contaminated fuel (containing both slurry and diesel) could advantageously be directed to a separate return tank to avoid contaminating the slurry fuel tank with fuel oil (which normally causes agglomeration of the slurry particles and settling).

It is to be appreciated that the fuel circulation system 100 and engine 112 can be used in a variety of applications, including as a stationary power generation engine, and a transportation engine, such as an engine in an ocean going vessel.

For ocean going vessels, the use of carbonaceous slurry fuels can advantageously address sulfur emissions limits for ocean vessels which in many jurisdictions have been restricted to use fuel oil on board with a sulphur content of no more than 0.5%, and in some cases of now more than 0.10% The sulfur content of carbonaceous slurry fuels, particularly micronized refined carbon fuel (MRC) can be tailored to meet this specific sulfur content restriction. An engine and fuel circulation system such as disclosed in relation to the present invention that uses such fuel can therefore assist in meeting these requirements.

Those skilled in the a will appreciate that the invention described herein is susceptible to variations and modifications other than those specifically described, it is understood that the invention includes all such variations and modifications which fall within the spirit and scope of the present invention.

Where the terms "comprise", "comprises", "comprised" or "comprising" are used in this specification (including the claims) they are to be interpreted as specifying the presence of the stated features, integers, steps or components, but not precluding the presence of one or more other feature, integer, step, component or group thereof.

The invention claimed is:

1. A method for controlling fuel circulation in a diesel type engine using carbonaceous aqueous slurry fuels, carbonaceous emulsion fuels or mixtures thereof, the diesel type engine including a fuel circulation system and a fuel injection system which is fluidly connected to the fuel circulation system, the fuel circulation system comprising:

at least one fuel feed pump comprising a positive displacement pump located in the fuel circulation system before the fuel injection system, the fuel feed pump configured to supply a controlled amount of carbonaceous aqueous slurry fuel to the fuel injection system; and at least one volumetric flow controller comprising at least one of a second positive displacement pump configured to operate in reverse as a positive displacement pressure let-down device, or a volumetric flow valve operated as a positive displacement pressure let-down device, the volumetric flow controller located in the fuel circulation system after the fuel injection system, the volumetric flow controller providing a controlled regulation of return flow/fuel system pressure from the fuel injection system from zero to maximum flow/pressure, the method including the step of:

adjusting the relative speed of the fuel feed pump and the volumetric flow controller to control at least one of:

fuel supply pressure; or fuel flow rate, wherein the fuel circulation system includes a preheater fluidly connected between the fuel feed pump and fuel injection system, and wherein the relative speed of the fuel feed pump and the volumetric flow controller is adjusted to achieve a desired fuel temperature by increasing the heat transfer coefficient on the fuel side of the preheater.

2. A method according to claim 1, wherein the relative speed of the fuel feed pump and the volumetric flow controller is adjusted to control at least one of:

(i) fuel flow rate to prevent particle sedimentation in the fuel;

(ii) changes to the fuel rheology and destabilisation by over working due to excessive circulation around the fuel system;

(iii) fluid flow for fuel change over; or (iv) flow of flushing fluid and more efficient and quicker flushing of the fuel system.

3. A method according to claim 1, wherein the fuel injection system further includes an injector bleed or by-pass valve for regulating circulating flow carbonaceous aqueous slurry fuel through the fuel injection system, and wherein the relative speed of the fuel feed pump, the volumetric flow controller and the injector bleed or by-pass valves is adjusted to control at least one of:

(i) fuel supply pressure;

(ii) flow rate to prevent sedimentation in the fuel; or (iii) fuel flow rate to minimise adverse changes to the fuel rheology and destabilisation by over working due to excessive circulation around the fuel system.

4. A method according to claim 1, wherein the fuel injection system further includes an injector bleed or by-pass valve for regulating circulating flow carbonaceous aqueous slurry fuel through the fuel injection system, and wherein the relative speed of the fuel feed pump, the volumetric flow controller and the injector bleed or by-pass valves is adjusted to provide at least one of:

(i) fuel supply pressure;

(ii) fuel flow rate;

(iii) fuel flow rate to prevent sedimentation in the fuel;

(iv) fuel flow rate to minimise adverse changes to the fuel rheology and destabilisation by over working due to excessive circulation around the fuel system;

(v) fluid flow for fuel change over; or (vi) flow of flushing fluid and more efficient and quicker flushing of the fuel system.

5. A method for controlling fuel circulation in a diesel type engine using carbonaceous aqueous slurry fuels, carbonaceous emulsion fuels or mixtures thereof, the diesel type engine including a fuel circulation system and a fuel injection system which is fluidly connected to the fuel circulation system, the fuel circulation system comprising:

at least one fuel feed pump comprising a positive displacement pump located in the fuel circulation system before the fuel injection system, the fuel feed pump configured to supply a controlled amount of carbonaceous aqueous slurry fuel to the fuel injection system; and at least one volumetric flow controller comprising at least one of a second positive displacement pump configured to operate in reverse as a positive displacement pressure let-down device, or a volumetric flow valve operated as a positive displacement pressure let-down device, the volumetric flow controller located in the fuel circulation system after the fuel injection system, the volumetric flow controller providing a controlled regulation of return flow/fuel system pressure from the fuel injection system from zero to maximum flow/pressure, and the fuel injection system further includes an injector bleed or by-pass valve for regulating circulating flow carbonaceous aqueous slurry fuel through the fuel injection system, the method includes the step of:

adjusting the relative speed of the fuel feed pump, the volumetric flow controller and the injector bleed or by-pass valves to control or provide at least one of:

(i) fuel supply pressure;

(ii) fuel flow rate;

(iii) fuel flow rate to prevent sedimentation in the fuel;

(iv) fuel flow rate to minimise adverse changes to the fuel rheology and destabilisation by over working due to excessive circulation around the fuel system;

(v) fluid flow for fuel change over; or (vi) flow of flushing fluid and more efficient and quicker flushing of the fuel system.

6. A method according to claim 5, wherein the fuel circulation system includes a preheater fluidly connected between the fuel feed pump and fuel injection system, and wherein the relative speed of the fuel feed pump and the volumetric flow controller is adjusted to achieve a desired fuel temperature by increasing the heat transfer coefficient on the fuel side of the preheater.

7. A method according to claim 5, wherein the relative speed of the fuel feed pump and the volumetric flow controller is adjusted to control at least one of:

(i) fuel flow rate to prevent particle sedimentation in the fuel;

(ii) changes to the fuel rheology and destabilisation by over working due to excessive circulation around the fuel system;

(iii) fluid flow for fuel change over; or (iv) flow of flushing fluid and more efficient and quicker flushing of the fuel system.

8. A method for controlling fuel circulation in a diesel type engine using carbonaceous aqueous slurry fuels, carbonaceous emulsion fuels or mixtures thereof, the diesel type engine including a fuel circulation system and a fuel injection system which is fluidly connected to the fuel circulation system, the fuel circulation system comprising:

at least one fuel feed pump comprising a positive displacement pump located in the fuel circulation system before the fuel injection system, the fuel feed pump configured to supply a controlled amount of carbonaceous aqueous slurry fuel to the fuel injection system; and at least one volumetric flow controller comprising at least one of a second positive displacement pump configured to operate in reverse as a positive displacement pressure let-down device, or a volumetric flow valve operated as a positive displacement pressure let-down device, the volumetric flow controller located in the fuel circulation system after the fuel injection system, the volumetric flow controller providing a controlled regulation of return flow/fuel system pressure from the fuel injection system from zero to maximum flow/pressure, the method includes the step of:

adjusting the relative speed of the fuel feed pump and the volumetric flow controller to control at least one of:

(i) fuel flow rate to prevent particle sedimentation in the fuel;

(ii) changes to the fuel rheology and destabilisation by over working due to excessive circulation around the fuel system;

(iii) fluid flow for fuel change over; or (iv) flow of flushing fluid and more efficient and quicker flushing of the fuel system.

9. A method according to claim 5, wherein the fuel circulation system includes a preheater fluidly connected between the fuel feed pump and fuel injection system, and wherein the relative speed of the fuel feed pump and the volumetric flow controller is adjusted to achieve a desired fuel temperature by increasing the heat transfer coefficient on the fuel side of the preheater.

* * * * *